US012169071B2

(12) United States Patent
Goodman

(10) Patent No.: US 12,169,071 B2
(45) Date of Patent: Dec. 17, 2024

(54) USER INTERFACE FOR HEATER

(71) Applicant: MILWAUKEE ELECTRIC TOOL CORPORATION, Brookfield, WI (US)

(72) Inventor: Alexander J. Goodman, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 391 days.

(21) Appl. No.: 17/516,897

(22) Filed: Nov. 2, 2021

(65) Prior Publication Data

US 2022/0136704 A1 May 5, 2022

Related U.S. Application Data

(60) Provisional application No. 63/109,515, filed on Nov. 4, 2020.

(51) Int. Cl.

| | |
|---|---|
| ***F24C 3/12*** | (2006.01) |
| ***F24C 3/14*** | (2021.01) |
| ***F24H 3/04*** | (2022.01) |
| ***F24H 9/20*** | (2022.01) |

(52) U.S. Cl.

CPC ..... *F24C 3/124* (2013.01); *F24C 3/122* (2013.01); *F24C 3/14* (2013.01); *F24H 3/0488* (2013.01); *F24H 9/2085* (2013.01)

(58) Field of Classification Search

CPC ..... F24H 3/0488; F24H 9/2085

See application file for complete search history.

(56) References Cited

U.S. PATENT DOCUMENTS

| | | | |
|---|---|---|---|
| 1,958,331 | A | 5/1934 | Bell |
| 2,268,778 | A | 1/1942 | Schueder et al. |
| 2,284,138 | A | 5/1942 | Evans et al. |
| 2,362,258 | A | 11/1944 | Findley |
| 2,363,168 | A | 11/1944 | Findley |
| 2,515,525 | A | 7/1950 | Modlin |
| 2,619,953 | A | 12/1952 | Cunningham |
| 2,744,516 | A | 5/1956 | Hubbard |
| 2,752,911 | A | 7/1956 | Fisher |

(Continued)

FOREIGN PATENT DOCUMENTS

| | | | |
|---|---|---|---|
| CN | 105972819 | B | 3/2019 |
| DE | 4126745 | A1 | 2/1992 |

(Continued)

OTHER PUBLICATIONS

FEMA_solenoid_lock_out_units (Year: 2018).*

(Continued)

*Primary Examiner* — Michael G Hoang
*Assistant Examiner* — Kurt J Wolford
(74) *Attorney, Agent, or Firm* — Michael Best & Friedrich LLP

(57) ABSTRACT

A heater including a cylindrical housing with an inlet end, an outlet end, and an axis extending between the inlet end and the outlet end. A combustion chamber is positioned at least partially within the cylindrical housing. A base is coupled to the cylindrical housing. A user interface is operable to control combustion within the combustion chamber. The axis is positioned between the base and the user interface.

17 Claims, 6 Drawing Sheets

(56) References Cited

U.S. PATENT DOCUMENTS

| | | | | |
|---|---|---|---|---|
| 2,969,450 | A * | 1/1961 | Bernstein | A47J 37/0623 219/400 |
| 2,994,520 | A | 8/1961 | Sherman | |
| 3,029,863 | A | 4/1962 | Downs | |
| 3,127,924 | A | 4/1964 | Downs | |
| 3,916,870 | A | 11/1975 | Beavers | |
| 4,002,157 | A | 1/1977 | Toesca | |
| D256,273 | S | 8/1980 | Townsend et al. | |
| 4,292,950 | A | 10/1981 | Schossow | |
| 4,313,417 | A | 2/1982 | Briggs et al. | |
| 4,635,382 | A | 1/1987 | Bourdeau | |
| 4,836,444 | A | 6/1989 | Kawamura | |
| D319,694 | S | 9/1991 | Wortham | |
| 5,052,367 | A | 10/1991 | Beavers et al. | |
| 5,081,849 | A * | 1/1992 | Thompson | F24F 13/20 62/262 |
| 5,121,739 | A | 6/1992 | Barker | |
| D341,417 | S | 11/1993 | Wortham | |
| D347,683 | S | 6/1994 | Chiu et al. | |
| 5,509,604 | A | 4/1996 | Chung | |
| 6,213,761 | B1 | 4/2001 | Schmidt | |
| 6,340,298 | B1 | 1/2002 | Vandrak et al. | |
| 6,470,876 | B1 | 10/2002 | Schmidt et al. | |
| 6,648,635 | B2 | 11/2003 | Vandrak et al. | |
| 6,884,065 | B2 | 4/2005 | Vandrak et al. | |
| 7,300,278 | B2 | 11/2007 | Vandrak et al. | |
| 7,600,998 | B1 | 10/2009 | Pitchford et al. | |
| 7,814,764 | B1 | 10/2010 | Heater et al. | |
| 7,913,416 | B1 | 3/2011 | Scieri | |
| 8,053,709 | B2 | 11/2011 | Vandrak et al. | |
| 8,068,724 | B2 | 11/2011 | Vandrak et al. | |
| 8,347,875 | B2 | 1/2013 | Jamieson | |
| 8,434,469 | B2 | 5/2013 | Vandrak | |
| D686,713 | S | 7/2013 | Kimpara | |
| 8,487,221 | B2 | 7/2013 | Vandrak et al. | |
| 8,494,350 | B2 | 7/2013 | O'Toole et al. | |
| 8,684,276 | B2 | 4/2014 | Vandrak | |
| 8,863,736 | B2 | 10/2014 | Vandrak | |
| 8,893,706 | B2 | 11/2014 | Vandrak et al. | |
| 8,893,707 | B2 | 11/2014 | Jamieson | |
| 9,219,213 | B2 | 12/2015 | Van Der Sluis et al. | |
| 9,222,682 | B2 | 12/2015 | Vandrak | |
| 9,267,704 | B1 | 2/2016 | Lee, Jr. | |
| 9,267,708 | B2 | 2/2016 | Jamieson | |
| 9,273,872 | B1 | 3/2016 | Lee, Jr. | |
| 9,291,363 | B1 | 3/2016 | Cassell et al. | |
| 9,435,563 | B2 | 9/2016 | Einhorn | |
| 9,447,981 | B2 | 9/2016 | Chan | |
| 9,599,367 | B1 | 3/2017 | Curry | |
| 9,927,144 | B2 | 3/2018 | Vandrak et al. | |
| 9,982,913 | B2 | 5/2018 | Kang | |
| 9,995,505 | B2 | 6/2018 | Giaretta et al. | |
| 10,495,344 | B2 | 12/2019 | Vandrak et al. | |
| D918,359 | S | 5/2021 | Francis | |
| D918,360 | S | 5/2021 | Francis | |
| 2002/0166553 | A1 | 11/2002 | Topp | |
| 2008/0302351 | A1 | 12/2008 | Hunter et al. | |
| 2009/0253092 | A1 | 10/2009 | Creed | |
| 2011/0045417 | A1 | 2/2011 | Vandrak | |
| 2011/0303211 | A1 | 12/2011 | Gove et al. | |
| 2012/0094244 | A1 | 4/2012 | Vandrak | |
| 2012/0145693 | A1 | 6/2012 | Deng | |
| 2012/0180784 | A1 | 7/2012 | Vandrak | |
| 2012/0240916 | A1 * | 9/2012 | Jedrzejek | F24H 9/2085 126/109 |
| 2013/0008423 | A1 * | 1/2013 | Noble | F24H 9/2085 432/29 |
| 2014/0099592 | A1 * | 4/2014 | Smith, III | F24H 3/0488 126/61 |
| 2015/0128483 | A1 | 5/2015 | Krupp et al. | |
| 2016/0146503 | A1 | 5/2016 | Kang | |
| 2016/0178237 | A1 | 6/2016 | Giaretta et al. | |
| 2016/0334136 | A1 * | 11/2016 | Giaretta | F24H 3/022 |
| 2017/0363326 | A1 | 12/2017 | Vandrak et al. | |
| 2017/0363327 | A1 | 12/2017 | Vandrak et al. | |
| 2019/0041093 | A1 | 2/2019 | Vandrak et al. | |
| 2019/0145663 | A1 * | 5/2019 | Huggins | F24H 15/345 392/365 |
| 2020/0072500 | A1 | 3/2020 | Vandrak et al. | |
| 2021/0071909 | A1 | 3/2021 | Erisgen | |

FOREIGN PATENT DOCUMENTS

| | | | |
|---|---|---|---|
| EP | 2784409 | B1 | 1/2017 |
| EP | 2863142 | B1 | 4/2019 |
| KR | 1020200119942 | A | 10/2020 |
| WO | 2009095944 | A2 | 8/2009 |
| WO | 2011130373 | A2 | 10/2011 |
| WO | 2015136341 | A1 | 9/2015 |
| WO | 2019233538 | A1 | 12/2019 |

OTHER PUBLICATIONS

PVC_Vent_Screens_Furnace_lockout_mode_reset_help (Year: 2020).*

Ryobi_Operators_manual_18V_hybrid_forced_air_propane_heater (Year: 2023).*

International Search Report and Written Opinion for Application No. PCT/US2021/057671 dated Feb. 23, 2022 (11 pages).

Extended European Search Report for Application No. 21889898.9 dated Oct. 25, 2024 (8 pages).

* cited by examiner

USER INTERFACE FOR HEATER

CROSS-REFERENCE TO RELATED APPLICATION

The present application claims priority to U.S. Provisional Patent Application No. 63/109,515 filed on Nov. 4, 2020, the entire content of which is incorporated herein by reference.

FIELD OF THE INVENTION

The present invention relates to heaters, and more particularly to portable combustion based, forced air heaters.

BACKGROUND OF THE INVENTION

A heater combusts an air and fuel mixture within a combustion chamber to generate heat. A fan draws ambient air into the heater and the air is heated by the combustion of the fuel. The heated air is then expelled out of the heater into an area to be heated.

SUMMARY OF THE INVENTION

The disclosure provides, in one aspect, a heater including a cylindrical housing with an inlet end, an outlet end, and an axis extending between the inlet end and the outlet end, a combustion chamber positioned at least partially within the cylindrical housing, a base coupled to the cylindrical housing, and a user interface operable to control combustion within the combustion chamber. The axis is positioned between the base and the user interface.

The disclosure provides, in one aspect, a heater including a cylindrical housing, a combustion chamber positioned at least partially within the cylindrical housing, a base coupled to the cylindrical housing, the base defining a bottom surface of the heater, and a user interface operable to control combustion within the combustion chamber. The user interface is positioned on a top surface of the heater, opposite the bottom surface.

The disclosure provides, in another aspect, a heater including a cylindrical housing with an inlet end, an outlet end, and an axis extending between the inlet end and the outlet end, a combustion chamber positioned at least partially within the cylindrical housing, a base coupled to the cylindrical housing, the base having a bottom surface defining a first plane on which the heater is supported, and a user interface operable to control combustion within the combustion chamber, the user interface defining a second plane that is parallel to the axis of the cylindrical housing.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
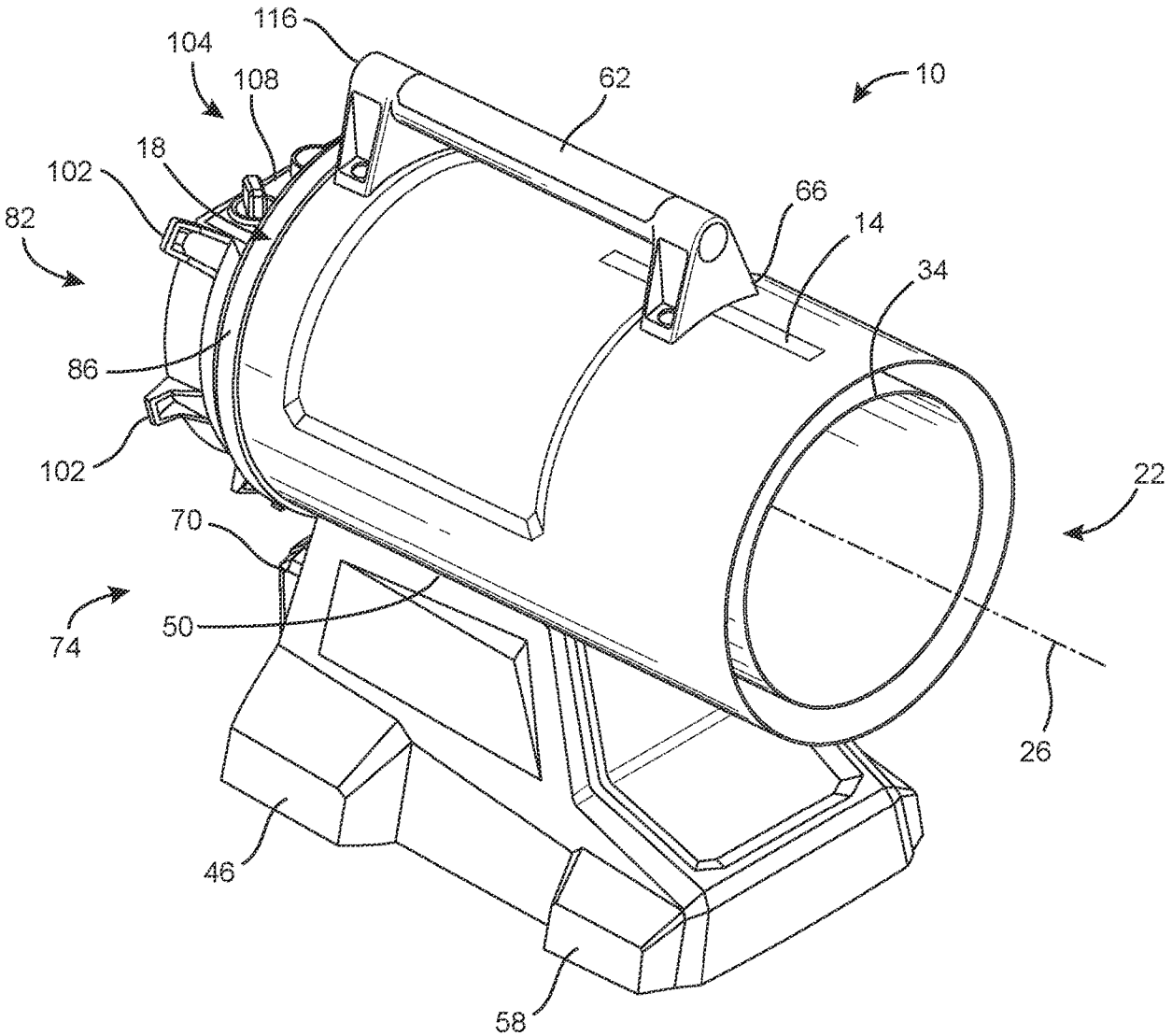
FIG. 1 is a front perspective view of a heater according to an embodiment of the disclosure.
Figure 2:
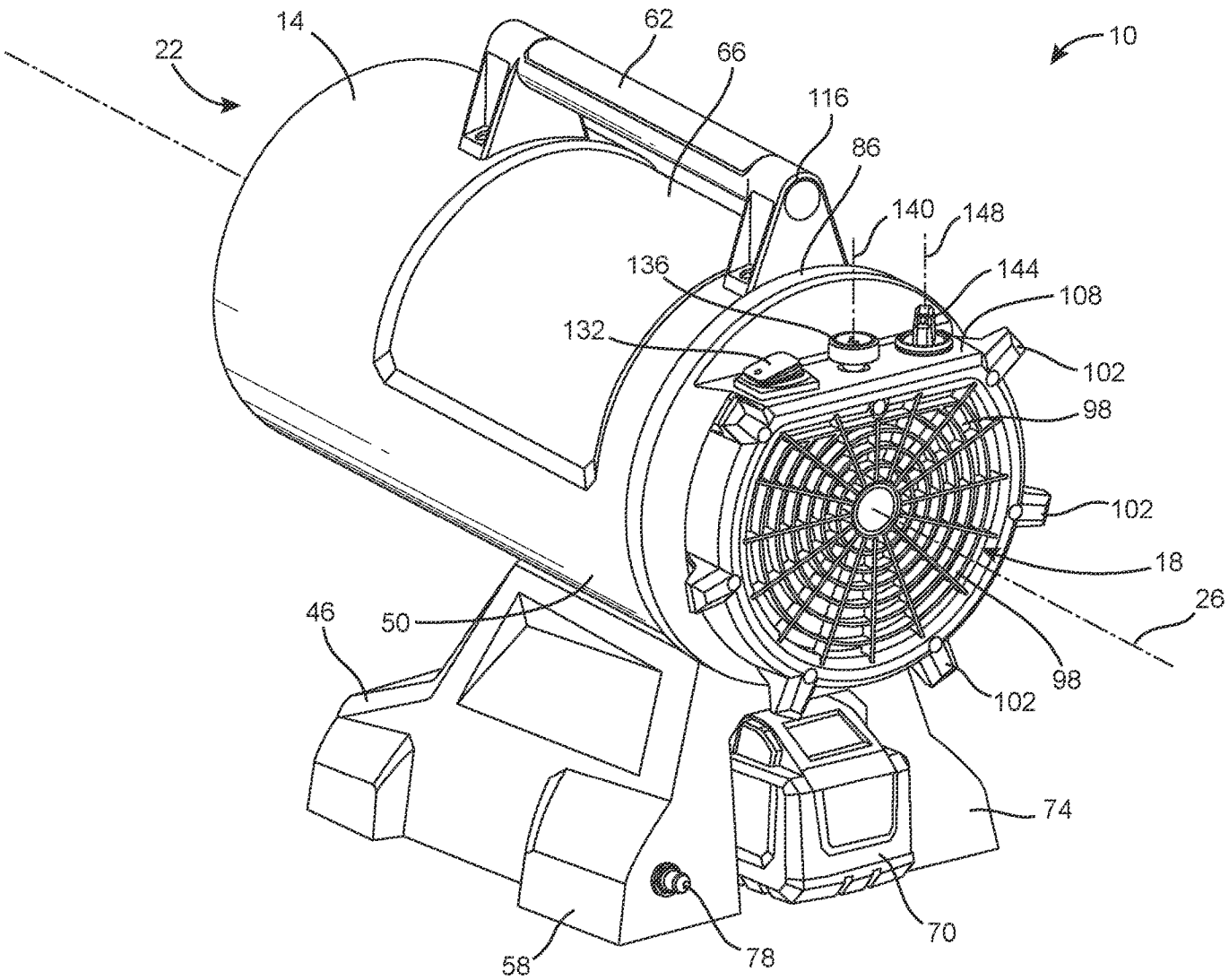
FIG. 2 is a rear perspective view of the heater of FIG. 1.
Figure 3:
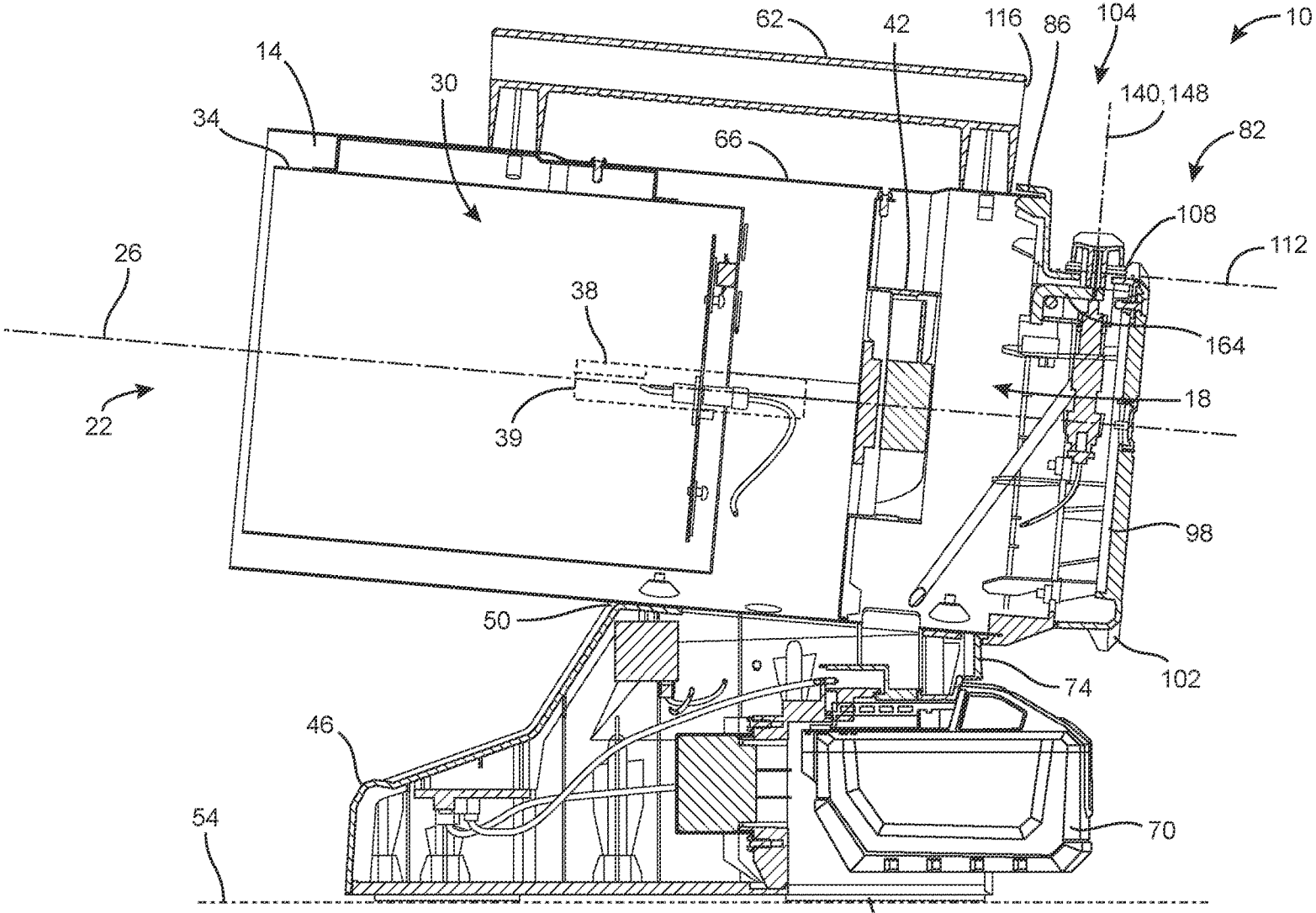
FIG. 3 is a cross-sectional view of the heater of FIG. 1.

With reference to FIGS. 1-3, a portable heater 10 is illustrated. The heater 10 is a forced air heater, drawing in ambient air and expelling heated air. The heater 10 is also a combustion-based heater that utilizes a combustible fuel (e.g., propane) to generate heat. The heater 10 includes a cylindrical housing 14 with an inlet end 18, an outlet end 22, and an axis 26 extending between the inlet end 18 and the outlet end 22. The axis 26 is the longitudinal axis of the cylindrical housing 14.

With reference to FIG. 3, a combustion chamber 30 is positioned at least partially within the cylindrical housing 14. In the illustrated embodiment, the combustion chamber 30 is at least partially defined by a cylindrical heat shield 34 positioned within the cylindrical housing 14. The axis 26 also defines the longitudinal axis of the cylindrical heat shield 34. An ignitor 38 and a burner 39 are positioned within the combustion chamber 30 and are operable to ignite and combust a supply of air and fuel.

With continued reference to FIG. 3, an axial flow fan 42 is positioned proximate but downstream of the inlet end 18 of the cylindrical housing 14 and configured to draw ambient air into the cylindrical housing 14. In the illustrated embodiment, the fan 42 is aligned with the combustion chamber 30 such that the axis 26 passes through the fan 42. The fan 42 draws in ambient air at the inlet end 18 and expels heated air from the outlet end 22.

With reference to FIGS. 1-3, the heater 10 includes a base 46 coupled to the cylindrical housing 14. Specifically, the base 46 is coupled to a lower portion 50 of the cylindrical housing 14 to support the cylindrical housing 14 at an elevation above an underlying support surface (e.g., the ground at a worksite). A lowermost portion 58 of the base 46 defines a plane 54 that coincides with the support surface on which the heater 10 is positioned. For example, the plane 54 may be oriented horizontally when the base 46 is set on a generally horizontal surface. The heater 10 further includes a handle 62 coupled to the cylindrical housing 14. Specifically, the handle 62 is coupled to an upper portion 66 of the cylindrical housing 14, opposite the lower portion 50 to which the base 46 is coupled. In other words, the handle 62 is positioned on the cylindrical housing 14 opposite the base 46.

With reference to FIG. 2, the heater 10 is configured to be powered by either a removable battery pack 70 or a standard household AC power source (e.g., 120V at 60 Hz). The battery pack 70 is insertable through a rear surface 74 of the base 46. The heater 10 includes a fuel inlet 78 positioned on the rear surface 74 of the base 46. The fuel inlet 78 is configured to receive a fuel line associated with a corresponding fuel tank. In some embodiments, a propane tank is attached to the fuel inlet 78 by a fuel line and a regulator. In other embodiments, different types of combustible fuels are utilized.

With continued reference to FIGS. 2 and 3, the heater 10 further includes a grill 82 positioned at the inlet end 18 of the cylindrical housing 14. The grill 82 includes a cylindrical flange 86 coupled to the cylindrical housing 14 by, for example, fasteners. The grill 82 also includes a plurality of openings 98 through which ambient air is drawn by the fan 42 (when activated), which then enters the inlet end 18 of the cylindrical housing 14. In the illustrated embodiment, the axis 26 extends through the grill 82. The grill 82 also includes a plurality of ribs 102 that extend radially outward from the axis 26 about which a fuel hose (not shown) can be wrapped and stored when not in use.

With reference to FIG. 2, the heater 10 includes a user interface 104 that is operable to control the combustion within the combustion chamber 30. The user interface 104 is positioned on the grill 82. In particular, the user interface is positioned on a top surface 108 of the grill 82. The top surface 108 defines a plane 112 that is parallel with the axis 26 of the cylindrical housing 14. Further, the plane 112 and the axis 26 are both oblique relative to the plane 54 of the base 46. In some embodiments, the plane 112 is parallel to the plane 54. The top surface 108 is positioned opposite the bottom surface 58 of the base 46. In other words, the top surface 108 faces upwards and the bottom surface 58 faces downwards. With reference to FIG. 3, the axis 26 is positioned between the base 46 and the user interface 104. In other words, the base 46 is positioned below the axis 26 and the user interface 104 is positioned above the axis 26, as viewed from the frame of reference of FIG. 3. In the illustrated embodiment, an end 116 of the handle 62 is positioned adjacent the user interface 104.

Figure 4:
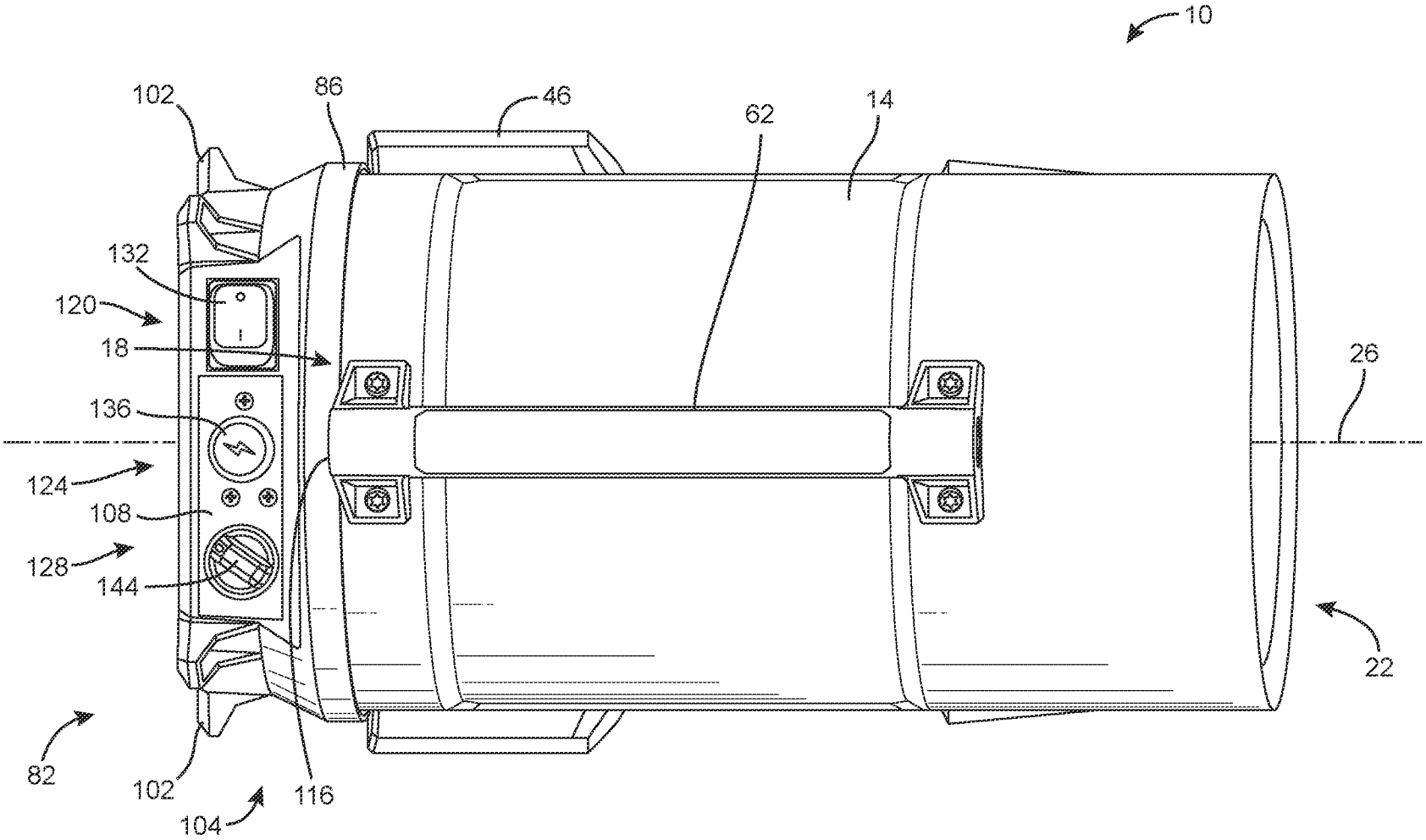
FIG. 4 is a top view of the heater of FIG. 1.

With reference to FIG. 4, the entirety of the user interface 104 is accessible from the top of the heater 10. The user interface is positioned adjacent the inlet end 18. This improves the user experience by allowing users to access the user interface 104 from above. Oftentimes conventional heaters are positioned on the ground and have a user interface positioned on the side of the heater, which is difficult to access or view. For example, users may need to bend over or otherwise adjust their perspective in order to view and access such side-mounted user interfaces on conventional heaters while positioned on the ground. And, with such side-mounted user interfaces on conventional heaters, the user interfaces can be positioned away from heat generating components and do not obstruct the flow of air through the heater.

Figure 5:
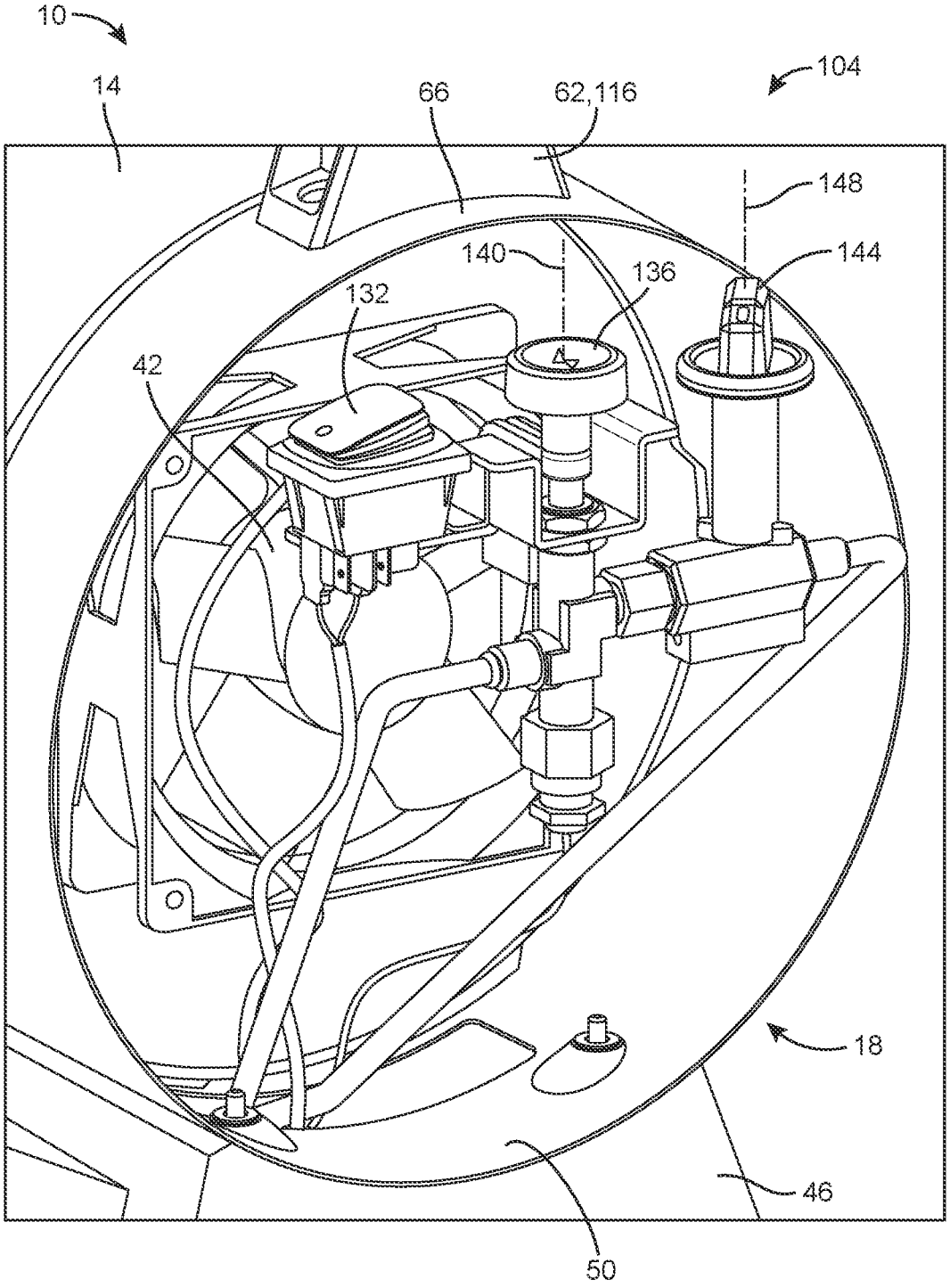
FIG. 5 is a partial rear perspective view of the heater of FIG. 1, with portions removed.

With reference to FIG. 4, the user interface 104 includes a first user input 120, a second user input 124, and a third user input 128. In the illustrated embodiment, the first user input 120 is a toggle switch 132 configured to turn a main power supply from the battery pack 70, for example, on and off. In the illustrated embodiment, the second user input 124 is a push-button 136 configured to energize the ignitor 38 and begin combustion. The push button 136 is depressed along an axis 140 (FIGS. 3 and 5) that intersects the plane 54 and the plane 112. In the illustrated embodiment, the third user input 128 is a rotatable knob 144 configured to adjust an amount of fuel being supplied to the burner 39 in the combustion chamber 30 (FIGS. 4 and 5). The knob 144 is rotatable about an axis 148 (FIGS. 3 and 5) that interests the plane 54 and the plane 112. In the illustrated embodiment, the axis 140 of the push button 136 is parallel with the rotational axis 148 of the knob 144, and both axes 140, 148 are oriented generally vertical. In other embodiments, different toggles, switches, dials, knobs, etc. may be utilized for any of the user inputs 120, 124, 128. In other embodiments, the user interface 104 may include two or fewer user inputs. In other embodiments, the user interface 104 may include four or more user inputs. The user interface 104 may also include a visual indicator, such as an LED or display screen, or an audio indicator, such as a buzzer, in some embodiments. For example, in some embodiments, the user interface 104 includes a LED indicator to provide a visual indication for when the user should actuate the igniter switch. Specifically, the LED indicator would not illuminate immediately upon turning the main power on but would wait a few seconds (e.g., 3 seconds) in order to allow the fan 42 to clear any old propane gas that may be in the combustion chamber 30.

Figure 6:
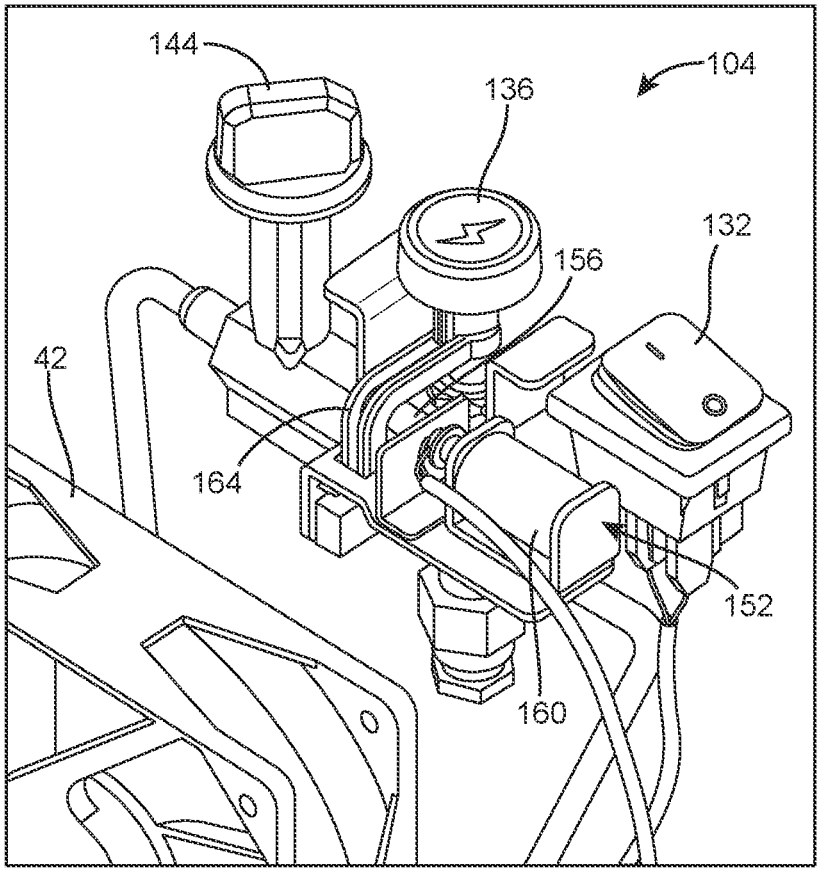
FIG. 6 is a partial front perspective view of the heater of FIG. 1, with portions removed.

With reference to FIG. 6, the user interface 104 further includes a lock-out solenoid 152 with a plunger 156 that extends from a solenoid housing 160. In some embodiments, the plunger 156 is biased (e.g., spring biased) out of the housing 160 and the solenoid 152 is energized to withdraw the plunger 156 into the housing 160. In other embodiments, the plunger 156 is biased into the housing 160 and the solenoid 152 is energized to extend the plunger 156 out of the housing 160. The plunger 156 is configured to interfere with and block movement of the push button 136. Specifically, an arm 164 extends from the push button 136 and is movable therewith as the push button 136 is depressed. The push button 136 is prevented from being depressed when the plunger 156 of the solenoid 152 is positioned directly below the arm 164, as shown in FIG. 6.

In operation, ambient air is drawn into the inlet end 18 of the cylindrical housing 14 by the fan 42, heated by the combustion occurring in the combustion chamber 30, and expelled as heated air from the outlet end 22. To begin operation, the first user input 120 (i.e., the on/off switch 132) is switched by a user from the OFF position to the ON position. When in the ON position, electrical power is provided to, for example, the fan 42 to activate the fan 42. And, the lock-out solenoid 152 is energized, thereby retracting the plunger 156 into the solenoid housing 160 and unblocking the arm 164 on the ignitor push button 136. The third user input 128 (i.e., the gas flow knob 144) is rotated to a minimum position (i.e., a low temperature position) to supply of fuel to the burner 39 within the combustion chamber 30. In some embodiments, the third user input 128 is depressed and rotated to reach the minimum position. The second user input 124 (i.e., the ignitor push button 136) is then depressed by a user to energize the ignitor 38 and begin combustion of the fuel. Once the burner 39 has been ignited, the second user input 124 can be released. Finally, the amount of fuel going to the burner 39 can be adjusted from the minimum position to a maximum position (i.e., a high temperature position) with rotation of the knob 144 about the axis 148. At all points during operation and during start up, the entire user interface 104 is visible from the top of the heater 10 and is readily accessible by a user.

Although the invention has been described in detail with reference to certain preferred embodiments, variations and modifications exist within the scope and spirit of one or more independent aspects of the invention as described.

Various features of the invention are set forth in the following claims.

What is claimed is:

1. A heater comprising:

a cylindrical housing with an inlet end, an outlet end, and an axis extending between the inlet end and the outlet end;

a combustion chamber positioned at least partially within the cylindrical housing;

a base coupled to the cylindrical housing, the base defining a bottom surface of the heater; and a user interface operable to control combustion within the combustion chamber;

wherein the axis is positioned between the base and the user interface; and a grill positioned at an inlet end of the cylindrical housing, the grill including a top surface positioned above the axis, and wherein the user interface is positioned on the top surface of the grill.

2. The heater of claim 1, wherein the grill includes a plurality of openings, and wherein the axis extends through the grill.

3. The heater of claim 1, wherein the base defines a first plane on which the heater is supported, and wherein the user interface defines a second plane that is oblique relative to the first plane.

4. The heater of claim 1, wherein the user interface includes a first user input configured to turn a main power supply on and off, a second user input configured to energize an ignitor, and a third user input configured to adjust an amount of fuel supplied to a burner.

5. The heater of claim 4, wherein the main power supply is a battery pack insertable through a rear surface of the base.

6. The heater of claim 4, wherein the user interface further includes a lock-out solenoid with a plunger that extends from a solenoid housing, and wherein the plunger is configured to interfere with and block movement of the second user input.

7. The heater of claim 1, wherein the user interface includes a visual indicator.

8. A heater comprising;

a cylindrical housing;

a combustion chamber positioned at least partially within the cylindrical housing;

a base coupled to the cylindrical housing, the base defining a bottom surface of the heater;

a user interface operable to control combustion within the combustion chamber, wherein the user interface is positioned on a top surface of the heater, opposite the bottom surface; and a grill positioned at an inlet end of the cylindrical housing, wherein the grill includes a plurality of openings, and wherein the grill defines the top surface on which the user interface is positioned.

9. The heater of claim 8, wherein the base defines a first plane on which the heater is supported, and wherein the user interface defines a second plane that is oblique relative to the first plane.

10. The heater of claim 8, wherein the user interface includes a first user input configured to turn a main power supply on and off, a second user input configured to energize an ignitor, and a third user input configured to adjust an amount of fuel supplied to a burner.

11. The heater of claim 10, wherein the main power supply is a battery pack insertable through a rear surface of the base.

12. The heater of claim 8, wherein the user interface includes a visual indicator.

13. A heater comprising:

a cylindrical housing with an inlet end, an outlet end, and an axis extending between the inlet end and the outlet end;

a combustion chamber positioned at least partially within the cylindrical housing;

a base coupled to the cylindrical housing, the base having a bottom surface defining a first plane on which the heater is supported;

a user interface operable to control combustion within the combustion chamber, the user interface defining a second plane that is parallel to the axis of the cylindrical housing; and a grill positioned at the inlet end of the cylindrical housing and includes a plurality of openings, wherein the axis extends through the grill, and wherein the user interface is positioned on the grill.

14. The heater of claim 13, wherein the user interface is positioned on a top surface of the grill.

15. The heater of claim 13, wherein the user interface includes a first user input configured to turn a main power supply on and off, a second user input configured to energize an ignitor, and a third user input configured to adjust an amount of fuel supplied to a burner.

16. The heater of claim 15, wherein the main power supply is a battery pack insertable through a rear surface of the base.

17. The heater of claim 13, wherein the second plane is oblique relative to the first plane.

* * * * *